US009879557B2

(12) United States Patent
Hall et al.

(10) Patent No.: US 9,879,557 B2
(45) Date of Patent: Jan. 30, 2018

(54) INNER STAGE TURBINE SEAL FOR GAS TURBINE ENGINE

(71) Applicant: UNITED TECHNOLOGIES CORPORATION, Hartford, CT (US)

(72) Inventors: Theodore W Hall, Berlin, CT (US); Michael G McCaffrey, Windsor, CT (US); Zachary Mott, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 209 days.

(21) Appl. No.: 14/737,852

(22) Filed: Jun. 12, 2015

(65) Prior Publication Data

US 2016/0047258 A1 Feb. 18, 2016

Related U.S. Application Data

(60) Provisional application No. 62/037,733, filed on Aug. 15, 2014.

(51) Int. Cl.

| | |
|---|---|
| ***F01D 11/00*** | (2006.01) |
| ***F01D 9/04*** | (2006.01) |
| ***F01D 11/08*** | (2006.01) |

(52) U.S. Cl.

CPC ..... *F01D 11/005* (2013.01); *F01D 9/04* (2013.01); *F01D 11/08* (2013.01); *F05D 2220/32* (2013.01); *F05D 2240/11* (2013.01); *F05D 2240/56* (2013.01); *F05D 2240/80* (2013.01); *F05D 2260/205* (2013.01)

(58) Field of Classification Search

CPC .... F02C 7/28; F05D 2240/55; F05D 2240/11; F05D 2240/56; F01D 11/08; F01D 11/005; F01D 11/001; F16J 15/03

See application file for complete search history.

(56) References Cited

U.S. PATENT DOCUMENTS

| | | | | |
|---|---|---|---|---|
| 5,114,159 | A | 5/1992 | Baird et al. | |
| 5,609,469 | A | 3/1997 | Worley et al. | |
| 6,170,831 | B1 * | 1/2001 | Bouchard | F01D 11/005 277/355 |
| 6,675,584 | B1 | 1/2004 | Hollis et al. | |
| 6,792,763 | B2 | 9/2004 | Sileo et al. | |
| 6,834,507 | B2 | 12/2004 | Jorgensen | |
| 7,093,835 | B2 | 8/2006 | Addis | |
| 7,178,340 | B2 | 2/2007 | Jorgensen | |
| 7,226,054 | B2 | 6/2007 | Addis | |
| 7,270,333 | B2 | 9/2007 | Addis | |
| 7,334,311 | B2 | 2/2008 | Addis | |
| 7,445,212 | B2 | 11/2008 | Gail et al. | |
| 7,516,962 | B2 | 4/2009 | Boeck | |
| 8,133,014 | B1 | 3/2012 | Ebert et al. | |
| 8,366,115 | B2 | 2/2013 | Addis | |

(Continued)

FOREIGN PATENT DOCUMENTS

| | | | |
|---|---|---|---|
| EP | 2469043 | A2 | 6/2012 |
| EP | 2589757 | A2 | 5/2013 |
| WO | 2014014760 | A1 | 1/2014 |

*Primary Examiner* — Dwayne J White
*Assistant Examiner* — Justin A Pruitt
(74) *Attorney, Agent, or Firm* — Bachman & LaPointe, P.C.

(57) ABSTRACT

A turbine section of a gas turbine engine includes a seal that extends between a vane platform and a Blade Outer Air Seal.

14 Claims, 5 Drawing Sheets

(56) References Cited

U.S. PATENT DOCUMENTS

| | | | |
|---|---|---|---|
| 8,376,697 | B2 | 2/2013 | Wiebe et al. |
| 8,388,309 | B2 | 3/2013 | Marra et al. |
| 8,632,075 | B2 | 1/2014 | Sha |
| 8,662,826 | B2 | 3/2014 | Willett, Jr. et al. |

* cited by examiner

INNER STAGE TURBINE SEAL FOR GAS TURBINE ENGINE

CROSS REFERENCE TO RELATED APPLICATION

This application claims the benefit of provisional application Ser. No 62/037,733, filed Aug. 15, 2014.

STATEMENT REGARDING FEDERALLY SPONSORED RESEARCH OR DEVELOPMENT

This disclosure was made with Government support under FA8650-09-D-29232 DO 0021 awarded by The United States Air Force. The Government has certain rights in this disclosure.

BACKGROUND

The present disclosure relates to components for a gas turbine engine, and more particularly, to cooling flow architecture and seal arrangements therefor.

Gas turbine engines, such as those that power modern commercial and military aircraft, generally include a compressor to pressurize an airflow, a combustor to burn a hydrocarbon fuel in the presence of the pressurized air, and a turbine to extract energy from the resultant combustion gases. The compressor and turbine sections include rotatable blade and stationary vane arrays. Within the turbine section, the radial outermost tips of each blade array are positioned in close proximity to a multiple of circumferentially arranged Blade Outer Air Seals (BOAS) supported by a BOAS support. The BOAS are located adjacent to the blade tips such that a radial tip clearance is defined therebetween. The BOAS support is, in turn, mounted adjacent to a vane support that supports a blade array. When in operation, the thermal environment in the engine varies and may cause thermal expansion and contraction. Clearance between components may thereby fluctuate such that a seal is typically located between the BOAS and the vane support.

Management of fuel consumption has gained much focus on both military and commercial engines. The High Pressure Turbine (HPT) efficiency of the turbine section has one of the most significant returns on fuel consumption. The HPT efficiency is negatively influenced by leakage of cooling air to the gaspath and the inherent mixing loss that occurs.

SUMMARY

A turbine section of a gas turbine engine according to one disclosed non-limiting embodiment of the present disclosure includes a seal that extends between a vane platform and a Blade Outer Air Seal.

A further embodiment of the present disclosure includes a vane support that at least partially supports a multiple of the vane platforms.

A further embodiment of any of the foregoing embodiments of the present disclosure includes a Blade Outer Air Seal support that at least partially supports a multiple of the Blade Outer Air Seals.

A further embodiment of any of the foregoing embodiments of the present disclosure includes a Blade Outer Air Seal support that extends from the vane support; the Blade Outer Air Seal support at least partially supports the Blade Outer Air Seal.

A further embodiment of any of the foregoing embodiments of the present disclosure includes a radial wall of the vane support that extends at least partially between the vane platform and the Blade Outer Air Seal support.

A further embodiment of any of the foregoing embodiments of the present disclosure includes, wherein the radial wall of the vane support extends toward the seal.

A further embodiment of any of the foregoing embodiments of the present disclosure includes, wherein the seal is mounted to the Blade Outer Air Seal support.

A further embodiment of any of the foregoing embodiments of the present disclosure includes, wherein the Blade Outer Air Seal support includes a multiple of circumferentially arranged lugs.

A further embodiment of any of the foregoing embodiments of the present disclosure includes, wherein the seal is a brush seal.

A turbine section of a gas turbine engine according to another disclosed non-limiting embodiment of the present disclosure includes a seal that extends axially beyond an end section of a radial wall of a vane support.

A further embodiment of any of the foregoing embodiments of the present disclosure includes, wherein the seal extends between a vane platform and a Blade Outer Air Seal.

A further embodiment of any of the foregoing embodiments of the present disclosure includes, wherein the vane support at least partially supports the vane platform.

A further embodiment of any of the foregoing embodiments of the present disclosure includes, wherein the Blade Outer Air Seal supports that at least partially supports a Blade Outer Air Seal.

A further embodiment of any of the foregoing embodiments of the present disclosure includes, wherein the Blade Outer Air Seal supports extends from the radial wall.

A further embodiment of any of the foregoing embodiments of the present disclosure includes, wherein the seal is a brush seal.

A method of interstage sealing within a gas turbine engine according to another disclosed non-limiting embodiment of the present disclosure includes sealing between a vane platform and a Blade Outer Air Seal, the seal extends axially beyond an end section of a radial wall of a vane support.

A further embodiment of any of the foregoing embodiments of the present disclosure includes a vane array with the vane support forward of the Blade Outer Air Seal.

A further embodiment of any of the foregoing embodiments of the present disclosure includes interfacing the vane support with the vane platform.

A further embodiment of any of the foregoing embodiments of the present disclosure includes axially sealing with the vane platform.

A further embodiment of any of the foregoing embodiments of the present disclosure includes supporting the seal on a Blade Outer Air Seal support that at least partially supports the Blade Outer Air Seal.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
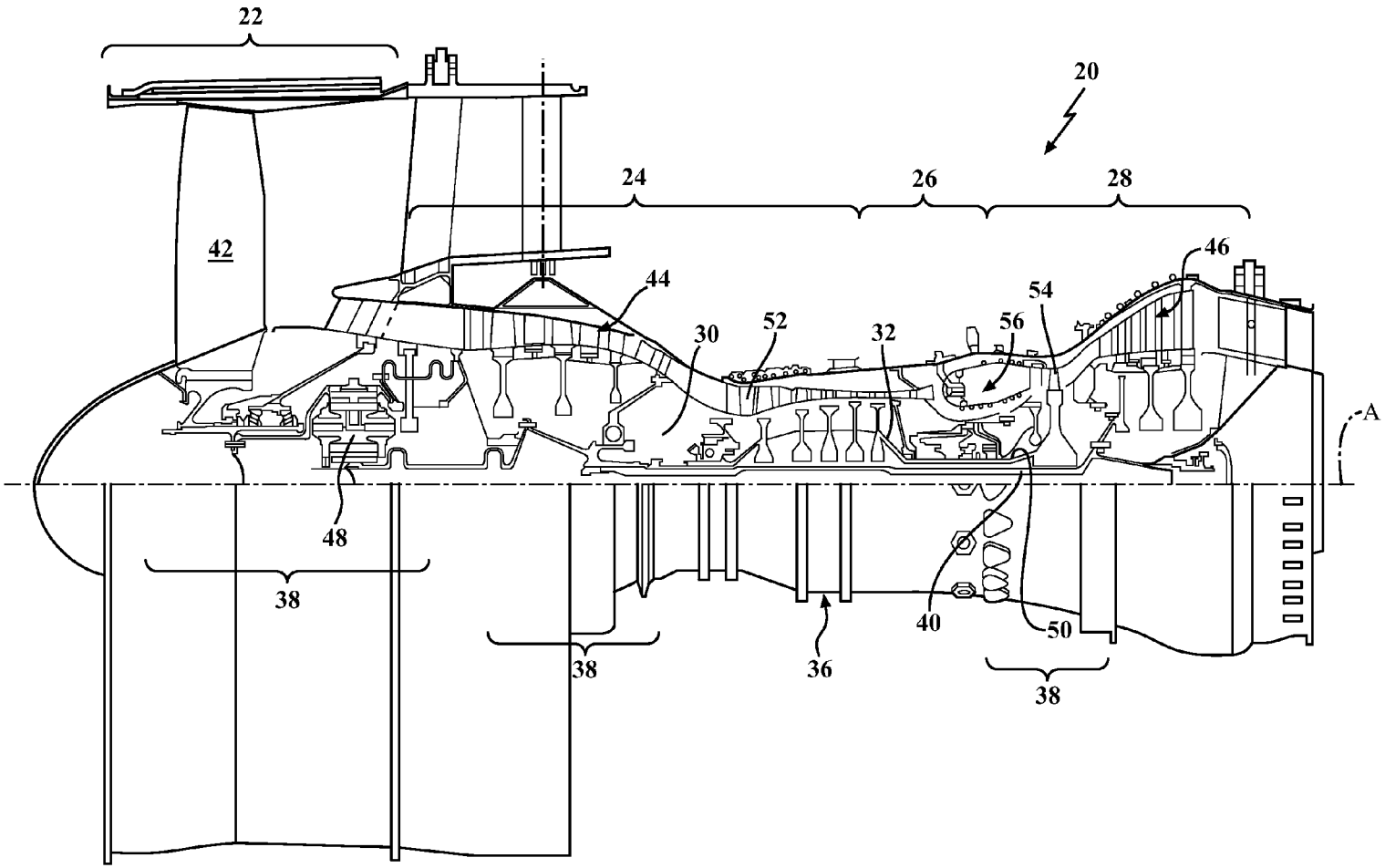
FIG. 1 is a schematic cross-section of an example gas turbine engine architecture.
Figure 2:
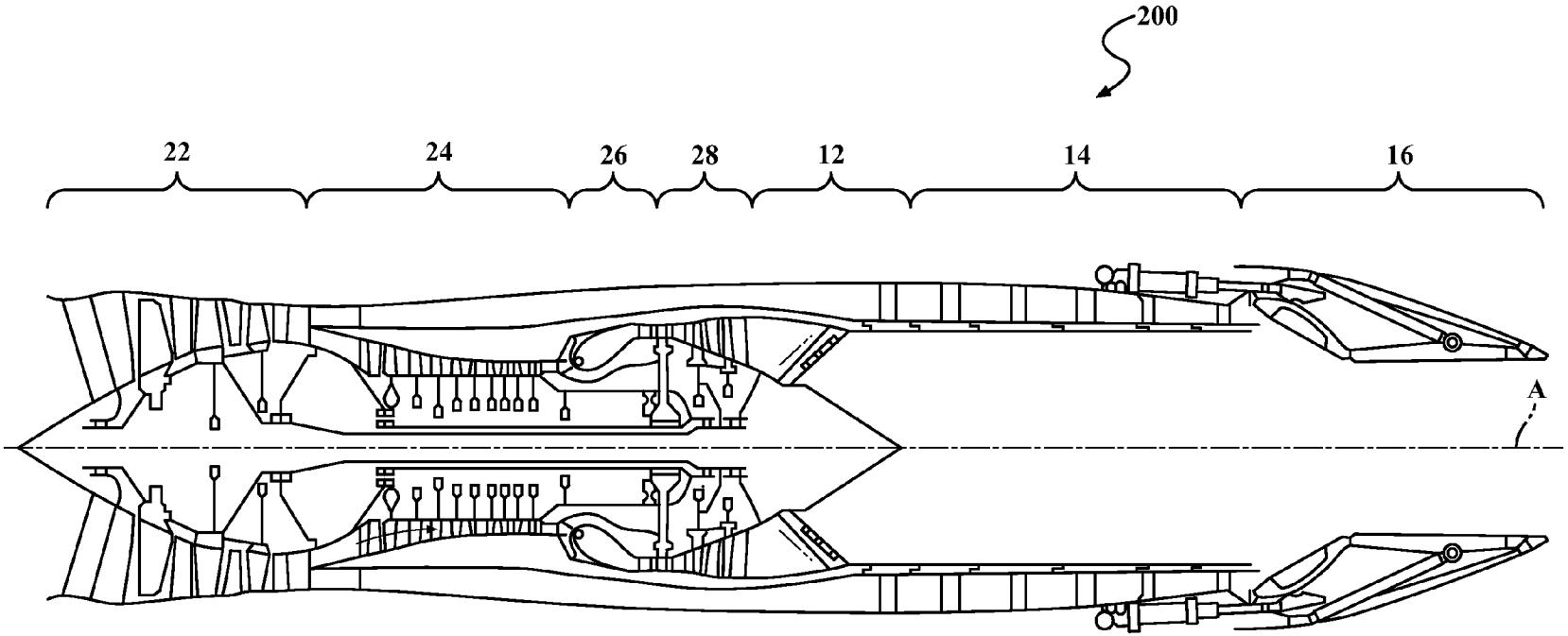
FIG. 2 is a schematic cross-section of another example gas turbine engine architecture.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engine architectures 200 might include an augmentor section 12, an exhaust duct section 14 and a nozzle section 16 (FIG. 2), among other systems or features. The fan section 22 drives air along a bypass flowpath and into the compressor section 24 which compresses the air along a core flowpath for communication into the combustor section 26, then expansion through the turbine section 28. Although depicted as a turbofan in the disclosed non-limiting embodiment, it should be appreciated that the concepts described herein are not limited to use with turbofans as the teachings may be applied to other types of turbine engine architectures such as turbojets, turboshafts, and three-spool (plus fan) turbofans.

The engine 20 generally includes a low spool 30 and a high spool 32 mounted for rotation about an engine central longitudinal axis A relative to an engine case structure 36 via several bearing compartments 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44, then the HPC 52, mixed with the fuel and burned in the combustor 56, then expanded threw the HPT 54 and the LPT 46, which rotationally drive the respective low spool 30 and high spool 32 in response to the expansion. The main engine shafts 40, 50 are supported at a plurality of points by bearing compartments 38 within the engine case structure 36.

Figure 3:
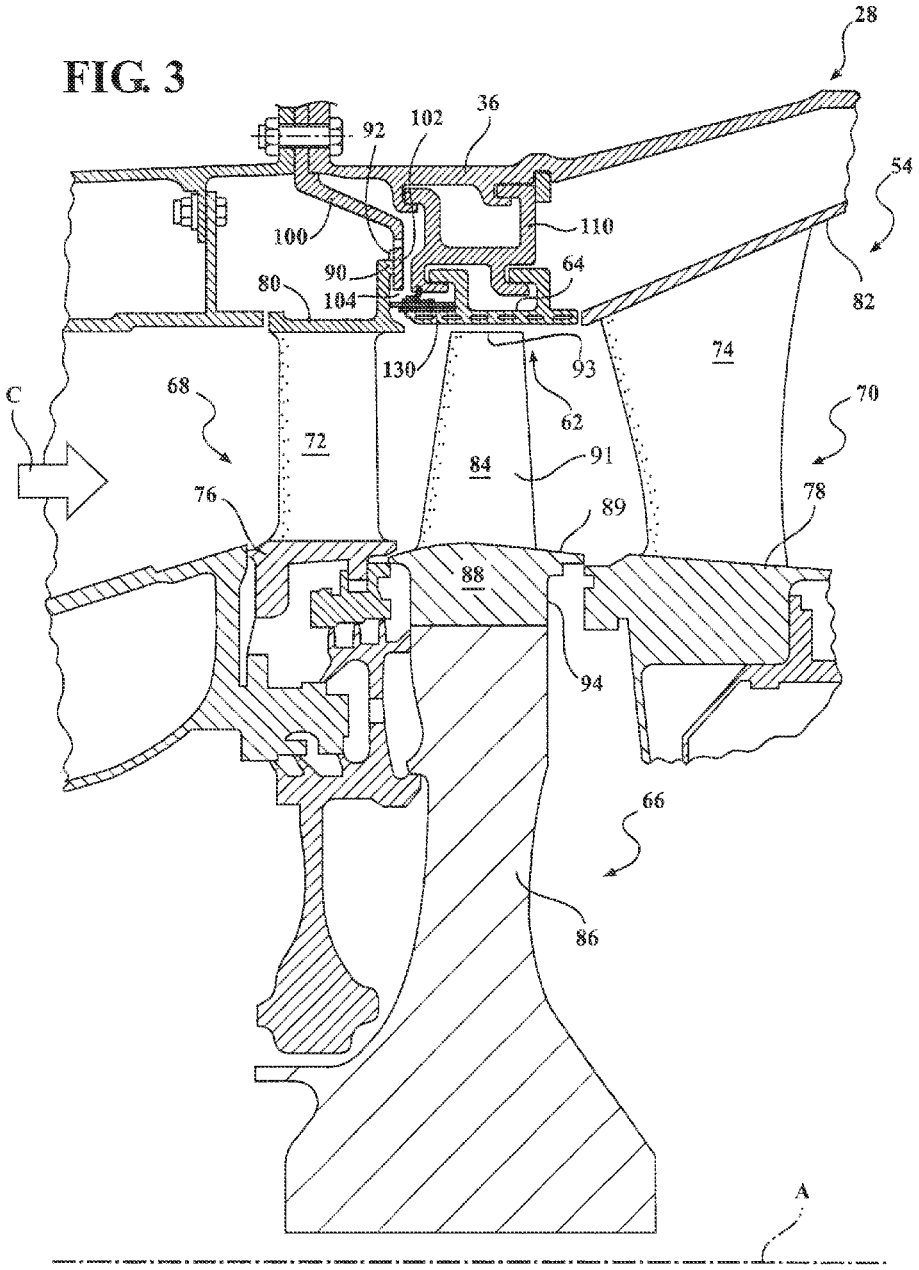
FIG. 3 is a schematic cross-section of an engine turbine section.

With reference to FIG. 3, an enlarged schematic view of a portion of the HPT 54 is shown by way of example; however, other engine sections will also benefit herefrom. A full ring shroud assembly 60 mounted to the engine case structure 36 supports a Blade Outer Air Seal (BOAS) assembly 62 with a multiple of circumferentially distributed BOAS 64 proximate to a rotor assembly 66 (one schematically shown).

Working gases produced in the combustor section 26, indicated schematically by arrow C, expand in the turbine section 28 and produce pressure gradients, temperature gradients and vibrations. The BOAS segments 64 are supported with respect to the shroud assembly 60 to provide for relative movement to accommodate the expansion caused by changes in pressure, temperature and vibrations encountered during operation of the gas turbine engine 20. Alternatively, the BOAS segments 64 are actively actuated to control a blade tip clearance.

The full ring shroud assembly 60 and the BOAS assembly 62 are axially disposed between a forward stationary vane ring 68 and an aft stationary vane ring 70. Each vane ring 68, 70 includes an array of vanes 72, 74 that extend between a respective inner vane platform 76, 78, and an outer vane platform 80, 82.

The rotor assembly 66 includes an array of blades 84 circumferentially disposed around a disk 86. Each blade 84 includes a root 88, a platform 89 and an airfoil 91. The blade roots 88 are received within a rim 94 of the disk 86 and the airfoils 91 extend radially outward such that a tip 93 of each airfoil 92 is closest to the blade outer air seal (BOAS) assembly 62. The platform 89 separates a gas path side inclusive of the airfoil 91 and a non-gas path side inclusive of the root 88.

Figure 4:
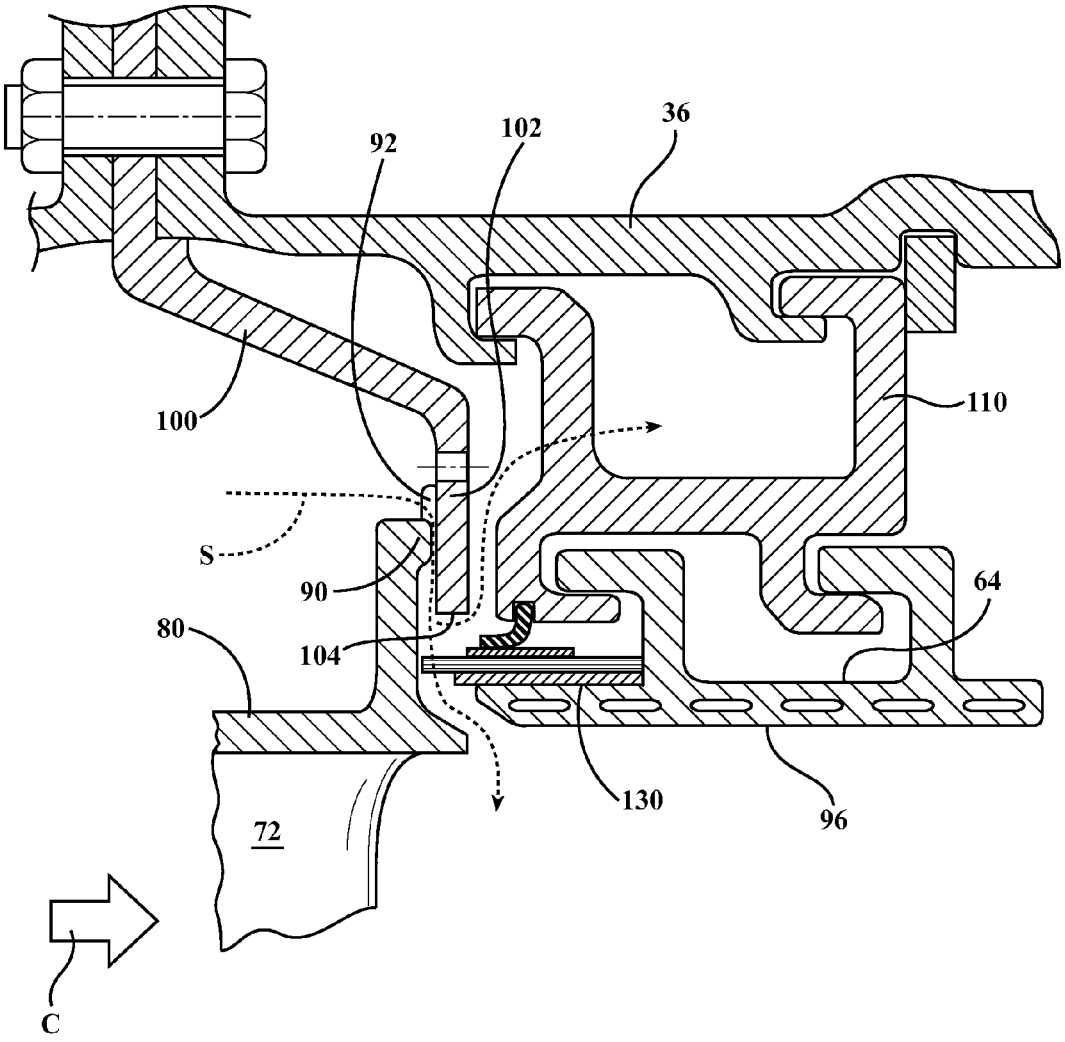
FIG. 4 is an enlarged schematic cross-section of an engine turbine section according to one disclosed non-limiting embodiment.

With reference to FIG. 4, the outer vane platform 80 of the array of vanes 72 is typically attached to the engine case structure 36 through a vane support 100 while the multiple of circumferentially distributed BOAS 64 are typically attached to the engine case structure 36 through a BOAS support 110. In one example, the outer vane platform 80 and the vane support 100 includes a multiple of circumferentially segmented lugs 90, 92 that circumferentially retain the array of vanes 72.

The vane support 100 and the BOAS support 110 are typically full ring components that isolate the thermal gradient experienced by each. That is, the vane support 100 and the BOAS support 110 are typically mounted to separate modules of the engine case structure 36.

Figure 5:
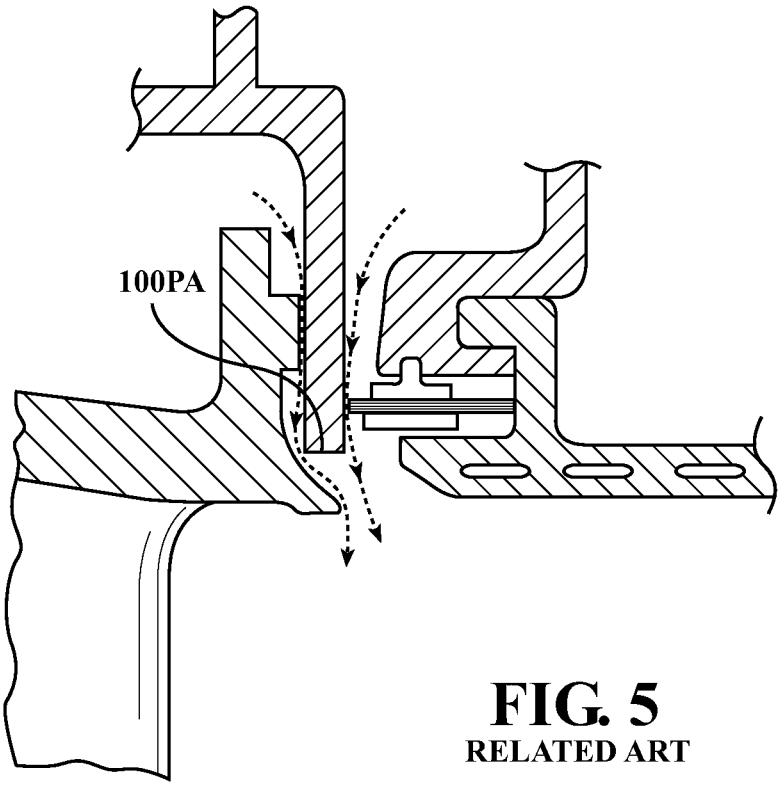
FIG. 5 RELATED ART
FIG. 5 is an enlarged schematic cross-section of a RELATED ART engine turbine section.

A seal 130, such as an axial brush seal, is mounted to the BOAS support 110 to extend axially between the BOAS 64 and the outer vane platform 80. The seal 130 extends axially beyond a distal end section 104 of a radial wall 102 to interface with the platform 80. That is, the radial wall 102 of the vane support 100 is relatively shorter than a convention radial wall 100PA (FIG. 5; RELATED ART) such that the seal 130 may interface directly with the outer vane platform 80. It should be appreciated that although the outer vane platform 80 is illustrated in the disclosed non-limiting embodiment, other outer and inner vane platforms, as well as other stages, will also benefit herefrom.

The architecture of the radial wall 102 that permits the seal 130 to interface directly with the outer vane platform 80 facilitates the capture of additional secondary airflow "S" leakage from the array of vanes 72, and recirculates the secondary airflow "S" for BOAS 64 and other downstream cooling. In addition to cooling the multiple of BOAS 64, the difference in pressure of cooling flow "S" is typically about 100-200 PSI (689-1379 kPa) greater than core flow "C" at the seal location, creating a strong tendency for the flow "S" to leak past the seal into the core flow "C."

The secondary airflow "S" is airflow different than the core gaspath flow "C" and is typically sourced from upstream sections of the engine 20 such as the compressor section 24 to provide a cooling airflow that is often communicated through the array of vanes 72 for cooling of components exposed to the core gaspath flow. The secondary airflow "S", however, typically leaks into the core gaspath flow (FIG. 5; RELATED ART).

Through capture of this leakage, losses are reduced and the secondary airflow that is leaked from the array of vanes 72 provides active cooling to the BOAS 64. Since sealing is relatively difficult due to the environment in the HPT, reductions in the number of potential leak paths facilitates reduction in secondary airflow losses associated with leakage into the gaspath. In one example, leakage has been reduced by about 30% that facilitates optimization of the entire engine for the reduced cooling flow leakage. In addition, reduced cooling flow leakage improves the structural life of the vane support 100.

Figure 6:
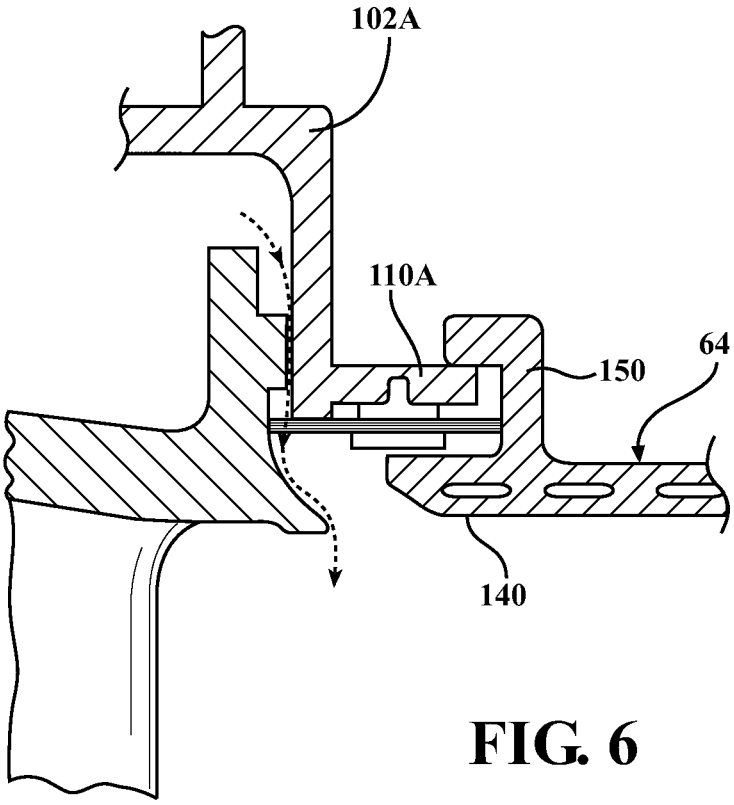
FIG. 6 is an enlarged schematic cross-section of an engine turbine section according to another disclosed non-limiting embodiment.

With reference to FIG. 6, in another disclosed non-limiting embodiment, the radial wall 102A of a vane support 100A includes an integral BOAS support 110A. That is, the BOAS support 110A extends axially from the radial wall 102A to support the multiple of BOAS 64. In one example, the integral BOAS support 110A includes a multiple of circumferentially segmented lugs 140 that receive lugs 150 that extend from each of the multiple of BOAS 64.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A turbine section of a gas turbine engine, comprising:
- an outer vane platform;
- a Blade Outer Air Seal adjacent to said outer vane platform; and
- a vane support that at least partially supports said outer vane platforms, a radial wall of said vane support extends toward an engine axis at least partially between said vane platform and said Blade Outer Air Seal support;
- a Blade Outer Air Seal support that at least partially supports said Blade Outer Air Seal; and
- a seal that extends axially with respect to the engine axis between said vane platform and said Blade Outer Air Seal, said seal extends axially beyond an end section of said radial wall to interface with the outer vane platform.

2. The turbine section as recited in claim 1, wherein the Blade Outer Air Seal support extends from said vane support, said Blade Outer Air Seal support at least partially supports said Blade Outer Air Seal and said seal.

3. The turbine section as recited in claim 1, wherein said radial wall of said vane support extends toward said seal.

4. The turbine section as recited in claim 1, wherein said Blade Outer Air Seal support includes a multiple of circumferentially arranged lugs to retain the Blade Outer Air Seal.

5. The turbine section as recited in claim 1, wherein said seal is a brush seal.

6. A turbine section of a gas turbine engine, comprising:
- a vane support including a radial wall that extends toward an engine axis at least partially between a vane portion and a Blade Outer Air Seal support; and
- a seal mounted to said Blade Outer Air Seal support, said seal extends axially beyond an end section of said radial wall to interface with an outer vane platform.

7. The turbine section as recited in claim 6, wherein said seal extends between said outer vane platform and a Blade Outer Air Seal.

8. The turbine section as recited in claim 7, wherein said vane support at least partially supports said outer vane platform via a multiple of circumferentially segmented lugs that circumferentially retain the array of vanes.

9. The turbine section as recited in claim 8, wherein said Blade Outer Air Seal supports that at least partially supports a Blade Outer Air Seal.

10. The turbine section as recited in claim 9, wherein said Blade Outer Air Seal supports extends from said radial wall.

11. The turbine section as recited in claim 6, wherein said seal is a brush seal.

12. A method of interstage sealing within a gas turbine engine, comprising:
- supporting a seal on a Blade Outer Air Seal support that at least partially supports a Blade Outer Air Seal; and
- sealing between a vane platform and the Blade Outer Air Seal with a seal that extends from the Blade Outer Air Seal axially beyond an end section of a radial wall of a vane support to interface with the vane platform such that a secondary airflow that is leaked from an array of vanes provides active cooling to the Blade Outer Air Seal wherein the vane array is forward of the Blade Outer Air Seal.

13. The method as recited in claim 12, further comprising interfacing the vane support with the vane platform via a multiple of circumferentially segmented lugs that circumferentially retain the array of vanes.

14. The method as recited in claim 12, further comprising axially sealing with the vane platform.

* * * * *